US005182932A

United States Patent [19]

Ritter et al.

[11] Patent Number: 5,182,932

[45] Date of Patent: Feb. 2, 1993

[54] APPARATUS FOR BENDING STEEL BARS TO FORM CONCRETE REINFORCEMENT ELEMENTS

[75] Inventors: Gerhard Ritter; Klaus Ritter; Gerhard Schmidt, all of Graz, Austria

[73] Assignee: EVG Entwicklungs-u. Verwertungs-Gesellschaft m.b.HH, Graz, Austria

[21] Appl. No.: 659,308

[22] PCT Filed: Jul. 30, 1990

[86] PCT No.: PCT/AT90/00076

§ 371 Date: May 15, 1991

§ 102(e) Date: May 15, 1991

[87] PCT Pub. No.: WO91/04113

PCT Pub. Date: Apr. 4, 1991

[30] Foreign Application Priority Data

Sep. 20, 1989 [AT] Austria ..... 2206/89
Feb. 8, 1990 [AT] Austria ..... 279/90

[51] Int. Cl.[5] ..... B21D 7/022; B21D 43/20

[52] U.S. Cl. ..... 72/217; 72/306; 72/422

[58] Field of Search ..... 72/149, 150, 157, 158, 72/212, 306, 387, 420, 421, 422, 217

[56] References Cited

U.S. PATENT DOCUMENTS

| | | | |
|---|---|---|---|
| 3,360,164 | 12/1967 | Zerlaut . | |
| 3,606,786 | 9/1971 | Taylor | 72/217 |
| 3,803,893 | 4/1974 | Peddinghaus et al. | 72/306 |
| 3,867,829 | 2/1975 | Bock | 72/321 |
| 4,311,031 | 1/1982 | Schwarze | 72/134 |
| 4,350,033 | 9/1982 | Ishihara | 72/217 |
| 4,388,039 | 6/1983 | Schwarze | 72/422 |
| 4,479,373 | 10/1984 | Montorfano et al. | 72/158 |
| 4,681,210 | 7/1987 | Miki et al. | 72/422 |
| 4,766,754 | 8/1988 | Shiue | 72/394 |
| 5,020,575 | 6/1991 | Grabuschnig et al. | 140/112 |

FOREIGN PATENT DOCUMENTS

| | | | |
|---|---|---|---|
| 0079587 | 5/1983 | European Pat. Off. . | |
| 0297201 | 1/1989 | European Pat. Off. | 140/112 |
| 1939660 | 2/1971 | Fed. Rep. of Germany . | |
| 2142321 | 3/1973 | Fed. Rep. of Germany | 140/112 |
| 1752130 | 5/1973 | Fed. Rep. of Germany | 72/422 |
| 3010923 | 10/1980 | Fed. Rep. of Germany . | |
| 3341714 | 5/1985 | Fed. Rep. of Germany . | |
| 3447995 | 2/1986 | Fed. Rep. of Germany . | |
| 3620151 | 2/1987 | Fed. Rep. of Germany | 72/306 |
| 3644482 | 7/1988 | Fed. Rep. of Germany | 72/426 |
| 227348 | 9/1985 | German Democratic Rep. . | |
| 554056 | 5/1977 | U.S.S.R. | 72/422 |
| 2026361 | 2/1980 | United Kingdom . | |
| 2169829 | 7/1986 | United Kingdom . | |

*Primary Examiner*—Robert L. Spruill
*Assistant Examiner*—Donald M. Gurley
*Attorney, Agent, or Firm*—Frishauf, Holtz, Goodman & Woodward

[57] ABSTRACT

Apparatus for bending steel bars to form concrete reinforcement elements, having a device (3, 4; 18) for feeding bars to a transfer device (8), by means of which in each case one group of bars can be inserted in two bending frames or stations, (2, 2'), each having members (11, 12) for bending the bars in transverse direction the transfer device having at least one pair of operation-controlled gripper tongs (10) which can be swivelled from a first position, in which they receive a plurality of bars from the bar feed device, and clamp the bars, into a second position, in which they insert the bars into the gap between the bending members.

17 Claims, 3 Drawing Sheets

APPARATUS FOR BENDING STEEL BARS TO FORM CONCRETE REINFORCEMENT ELEMENTS

FIELD OF THE INVENTION

The invention relates to an apparatus for bending steel bars to form concrete reinforcement elements, having a device for feeding bars to a transfer device, by means of which in each case one group of bars can be inserted between bending members in the transverse direction of the bars

BACKGROUND

In an apparatus of this type known from German Patent 3,010,923, bars compiled in groups by means of stops are fed successively on a sloping plane to the transfer device which feeds the groups of bars lying vertically above one another on a roller runway to a downstream tying device for tying off the group and to a bending machine, in which the group is bent into the desired shape. The main disadvantage of this apparatus consists in the fact that the groups of bars are passed without guiding to the transfer device. The transfer device has a plurality of rows of vertically disposed pairs of rollers; this can lead to malfunctions and misalignment of the bars. It is additionally disadvantageous in the known design that the groups of bars firstly have to be wrapped with tapes or wire or bonded to one another by welding so that they can subsequently be fed to the bending device in the longitudinal direction.

German Patent 3,644,482 discloses an apparatus for processing steel bars, having a tool, e.g. a bending slide, in which apparatus in each case a plurality of bars is transported both towards the bending slide and, after processing, away from the slide transversely to the longitudinal direction by means of arms which are mounted on both sides of the tool and can be swivelled as a unit. In this construction, the bars must be placed manually on the swivel arms. It is furthermore disadvantageous that the bars are not fixed on the swivel arms and, during swivelling of the arms, are held only by one step in the respective swivel arm. A further disadvantage emerges in the fact that the bars to be bent are placed on inclined, ramp-shaped elements and, after the lowering of the swivel arms, slide into an operating channel of the bending device only due to the force of gravity transversely to the longitudinal direction In this process, as a result of the simultaneous feeding of a plurality of bars, a mutual hindrance can take place during sliding, in particular if the bars are long and ribbed, thereby making a defined, orderly arrangement in the operating channel more difficult.

THE INVENTION

It is an object to provide an apparatus which avoids the disadvantages of the known apparatus and guarantees a reliable, simultaneous transfer of a group of bars from the feed device to the bending device. At the same time, the apparatus is intended to allow the satisfactory processing of bar material present in different shapes.

Briefly, according to the invention, the transfer device has at least one pair of operation-controlled gripper tongs which can be swivelled from a receiving position, in which they receive a plurality of bars from the bar feed device and clamp said bars, into an insertion position, in which they insert the bars into the gap between the bending members.

With this construction, a reliable reception of a group of bars is achieved which is held fixedly until it is placed between the bending members and, if appropriate, also during the bending operation so that the bars cannot change their mutual relative position.

In accordance with a preferred embodiment of the invention, the gripper tongs are arranged at the end of a swivel arm which is adjustable in a controlled telescopic manner. In this case, the jaws of the gripper tongs are expediently mounted so as to be jointly swivellable on the swivel arm in the form of a gripper tong head. By this means, the precision of the reception and transfer of the bars is improved.

The swivel arm is advantageously mounted so as to be swivellable on a frame bearing the bending members.

In one design of the invention, in the region of the receiving position of the gripper tongs, the frame has a buffer surface for bars fed by the bar feed device in the transverse direction of the bars, an alignment device being assigned to the buffer surface for mutual alignment of the one end of the bars. In this case, above the buffer surface, the bar feed device advantageously has a bar discharge device, by means of which bars can be fed individually in succession to the buffer surface.

In accordance with an alternative embodiment of the apparatus, the bar feed device has parallel, continuous, circulating conveyor units, between which the gripper tongs engage in their receiving position. In this case, a discharge device for the bars is advantageously arranged above the run-in end of the conveyor units, which discharge device has at least one swivel channel for discharging one bar in each case, a distributor flap or the like preferably being provided between the discharge device and the conveyor units for passing the bar to the conveyor units or away from the latter.

According to another feature of the invention, two frames are provided, which are adjustable relative to each other with mutual spacing in the longitudinal direction of the bars and which are each fitted with bending members and, on their inside, with swivel arms bearing gripper tongs, a common bar feed device and a common bar alignment device being assigned to the frames.

Furthermore, according to the invention in this embodiment one of the pairs of gripper tongs for clamping the bars can be actuated during the bending operation and/or during the adjustment of the frames.

In accordance with a development of the invention, provision is made for the transfer device to have a separate operating device for each pair of gripper tongs, each pair of gripper tongs, in turn, being fitted with a separate operating device for the controlled opening and closing of said gripper tongs. By this means, a reliable guiding and transfer of the bars is guaranteed during all phases of operation of the apparatus.

THE INVENTION

The invention is described in greater detail below by way of exemplary embodiments with reference to the drawings, in which:

FIG. 1 shows diagrammatically a perspective view of an apparatus according to the invention, FIG. 2 shows diagrammatically a section of a further exemplary embodiment of the invention and FIG. 3 shows a view of a detail of another embodiment of the apparatus.

DETAILED DESCRIPTION

Figure 1:
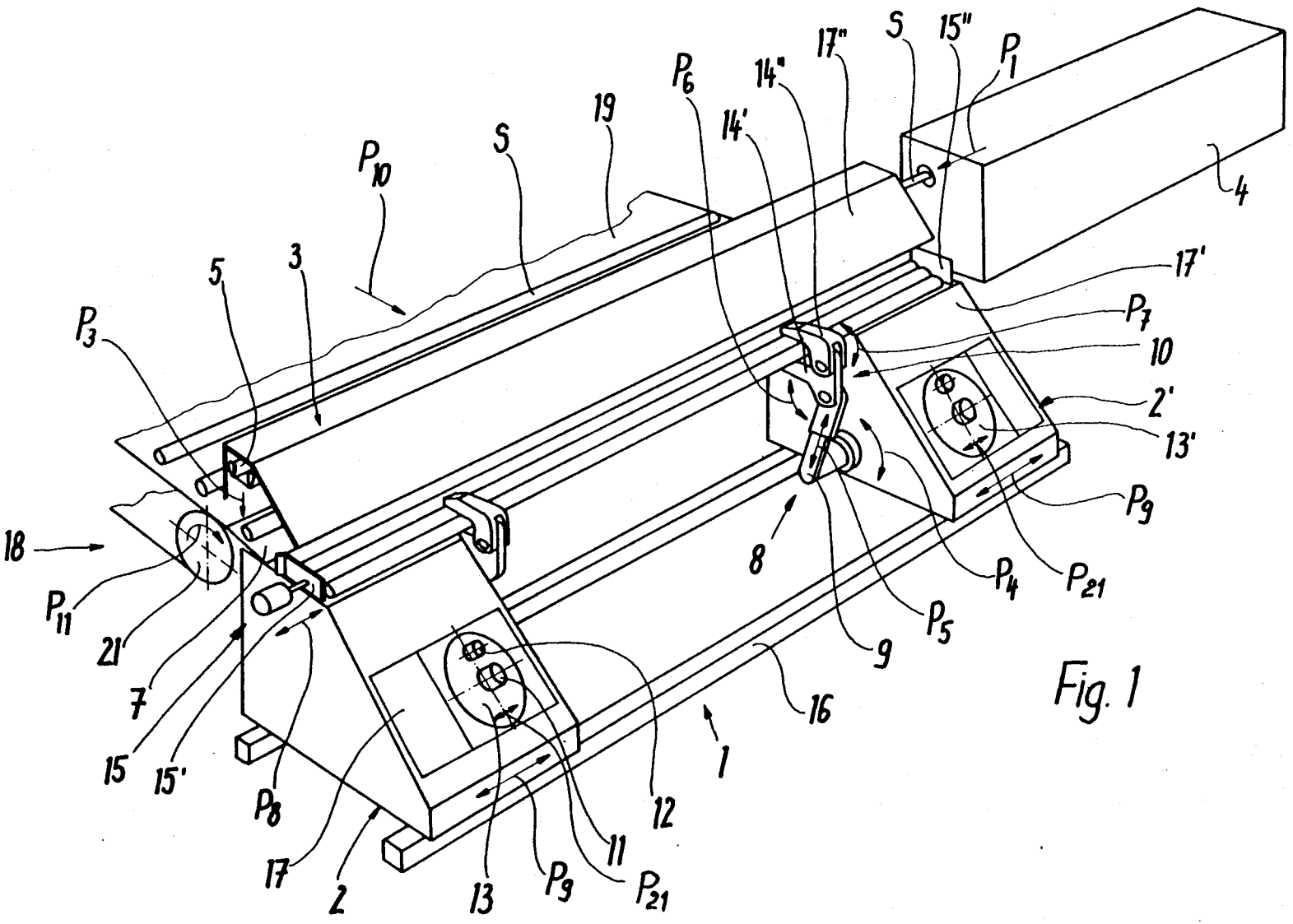

The bending apparatus 1 illustrated in FIG. 1 has two bending frames 2, 2', arranged spaced apart, for the simultaneous bending of a plurality of rods S. Provided above the bending apparatus 1 is a bar feed device and a bar feeding device 3. Rods S are fed individually by a lateral feed device 4 in the direction of the arrow $P_1$, i.e. in the longitudinal direction of the bars. The diagrammatically illustrated feed device 4 is suitable for feeding aligned, straight bars in standard lengths and is fitted with advancing rollers, a length measuring device and a pair of shears (not illustrated). A levelling device can be arranged upstream of the feed device 4 so that bar material coming from drums or reels can also be processed. If the bar material is already available in the required, ultimate finished length, the length measuring device and the shears are not required or are not in operation.

The bar feed device 3 has at least one discharge channel 5 arranged so as to be swivellable. After the swivelling of the discharge channel 5, the bar S drops in the direction of the arrow $P_3$ onto an inclined buffer and guide surface 7, e.g. formed by a plate on the upper side of the bending frames 2, 2' and rolls into a bar gripping and transfer device 8 which is in the receiving position for a plurality of bars and has two swivel arms 9 and associated gripper tongs 10.

Each swivel arm 9 is mounted so as to be swivellable on the inside of one of the bending frames 2 or 2' and can be swivelled corresponding to the arrow $P_4$ from the bar receiving position into a bending position. The bending position is defined by the location of a bending head 13 or 13' consisting of bending mandrel 11 and bending bolt 12, which bending head is expediently mounted in each of the bending frames 2 or 2' so as to be lowerable and operable in a controlled manner. In an alternative embodiment, solely the bending bolt 12 is lowerable.

Each swivel arm 9 is divided into two parts and is adjustable in height telescopically with its upper part bearing the gripper tong head 10 in relation to the lower part mounted on the bending frame corresponding to the double arrow $P_5$ in order to be able to bring the bars into the bending position between bending mandrel 11 and bending bolt 12 of the bending head 13. The gripper tongs 10 are attached so as to be swivellable on the upper part of the swivel arm 9 corresponding to the double arrow $P_6$ in order to be able to be positioned precisely in the receiving position and in order to be able to precisely pass the bars S to the bending heads 13, 13' of the bending frames 2, 2'. The gripper tongs 10 (see also FIG. 2) are formed by a lower jaw 14' and upper jaw 14'' which is swivellable corresponding to the double arrow $P_7$, which jaws are capable of holding the bars S fixedly during the swivel movement $P_4$ of the swivel arm 9 from the receiving position into the bending position and also during bending. Furthermore, the bars S, which are held fixedly by the jaws 14', 14'', can be lifted out of the bending position with the aid of the swivel arms 9 during the change in position of the bending tools required for reversing the bending direction to the extent that a lowering of the bending head or of one of the bending tools is not required for the change in position. Rather, the gripper tongs are actuated accordingly for transferring the bars from one side of the central bending mandrel 11 to the other side of the latter. Additionally, before carrying out the swivel movement $P_4$ of the swivel arm 9, the gripping jaw 14'' can be folded back into the receiving position to such an extent that the jaw 14'' does not collide with the bars in the bending heads 13, 13'.

The bending heads 13, 13' bearing the bending members 11, 12 are arranged so as to be displaceable corresponding to the double arrow $P_{21}$ (FIG. 1), i.e. in the longitudinal direction of the bars into the respective bending frames 2 or 2'. By this arrangement, the bending members 11, 12 are each displaceable relative to the gripper tongs 10 so that the bending of a reference arc with a radius greater than the radius of curvature of the central bending mandrel 11 is possible by dividing the overall bending process into a plurality of of successive partial bending steps. In this case, the reference arc is divided into a plurality of partial sections and the overall bending angle into a plurality of partial bending angles. A stepwise displacement of the bending members 11, 12 relative to the gripper tongs 10 clamping the bar material is obtained alternating with a partial bending around the partial bending angle corresponding to the length of the partial sections until the desired reference arc has been completed.

OPERATION

After the gripper tongs 10 have been filled with a predetermined number of bars S, the bars S are fixed with the aid of the jaw 14''. Before they are fastened in the gripper tongs 10, the bars S are aligned against a stationary stop 15'' with the aid of an extendable alignment device 15 which is arranged on a stationary component (not shown). For this purpose, the alignment device 15 is provided with a stop part 15' displaceable corresponding to the double arrow $P_8$. The bending frames 2, 2' of the bending apparatus 1 are displaceable corresponding to the double arrow $P_9$ on rails 16, which are indicated only diagrammatically, in order to be able to bend the bars at different bending points corresponding to the reinforcement rods or stirrups to be produced. During the adjustment of the bending frames, the bars are held fixedly by means of the gripper tongs 10 of one of the frames. The tongs 10 associated with the other frame are slightly opened for guiding the bars arranged above one another during the adjustment of the frames. The slight opening of the tongs allows the bars to glide in the slightly opened gripping jaws 14', 14'' gripping jaws 14', 14'' without changing the arrangement of the bars.

For reliable support of rods or stirrups with large bent-over limbs, a resting plate 17'' is provided on the bending frames 2, 2', in addition to the resting surfaces 17 and 17'. The stationary resting plate 17'' also serves as a covering plate for the bar feed device 3. The resting plate 17'' can also be of two-part construction, in which case each part is connected to a bending frame 2 or 2' and is displaceable with the latter.

As is shown in the exemplary embodiment illustrated in FIG. 1, it is also possible within the framework of the invention to feed bars S in their transverse direction, preferably horizontally, to the buffer and guide surface 7 and thus to the bar gripping and transfer device 8 with the aid of an additional bar feed device (FIG. 2) arranged on the rear side of the bending apparatus 1. That bar feed device 18, as shown in FIG. 2, suitably consists of one or more parallel continuous conveyor belts 19 which are guided at one end around rollers 21 rotating in the direction of arrow $P_{11}$ and are driven by means of a suitable device (not shown).

Figure 2:
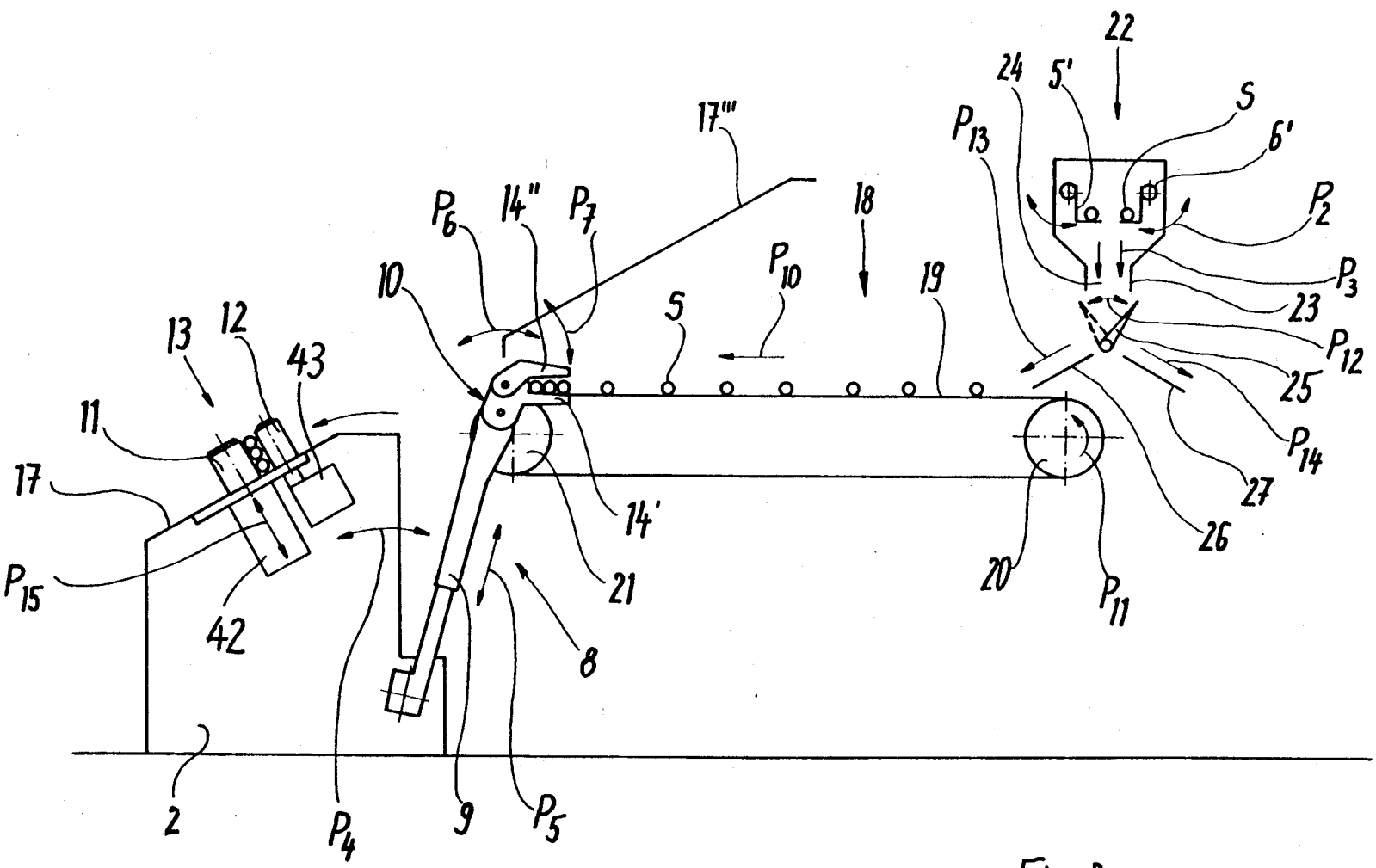

FIG. 2 also shows a further exemplary embodiment of an apparatus according to the invention. In this apparatus, the bars S are fed to a dropping and distributor device 22, which corresponds essentially to the dropping device 3 in accordance with FIG. 1, via a feed device 4 in accordance with FIG. 1 which can be loaded, as in the exemplary embodiment according to FIG. 1, with different shapes of bar material. The bar discharge device 22 has at least one swivellable discharge channel 5' which is arranged on a channel bearer 6' and can be swivelled corresponding to the double arrow $P_2$. Below the bar discharge, or dropping and distributor device 22 there is an adjoining discharge duct 24 provided with lateral guide plates 23 extending in the longitudinal direction of the bars, which discharge duct passes the bars S in the direction of the arrows $P_3$ to a distributor flap 25 which can be swivelled corresponding to the double arrow $P_{12}$. Depending on the position of the distributor flap 25, the bars S can either be passed to the bar feed device 18 by an inclined conductor plate 26, arranged above the bar feed device 18, which is constructed in form of circulating units. The bars drop in the direction of the arrow $P_{13}$ or, alternatively, forwarded to an unloading and intermediate magazine via a further, likewise inclined conductor plate 27, facing away from the bar feed device 18, in the direction of the arrow $P_{14}$. This form of the dropping and distributor device 22 is particularly advantageous for separating non-utilisable remnant lengths and is conceived, in particular, for the case that the higher operating speed of the dropping and distributor device 22 in relation to the relatively slow production speed of the bending device is to be fully exploited in order to provide for continuous operation.

The bars S are conveyed with the aid of the bar feed device 18 in the direction of the arrow $P_{10}$ into the gripper tongs 10 of the transfer device 8 which engage in their first position between the parallel, continuously circulating conveyor units of the bar feed device. After the gripper tongs 10 have been filled with the number of bars to be bent, the jaws 14'' close, if appropriate only after the alignment device 15, not illustrated in FIG. 2, has aligned the bars at the ends, and the swivel arms 9 swivel from the receiving position into the bending position.

In order to allow the bars S to be positioned between the bending mandrel 11 and the bending bolt 12, it is possible, as illustrated in the exemplary embodiment according to FIG. 2, either to displace the upper part of the swivel arm 9 in its height corresponding to the double arrow $P_5$ or to lower the entire bending head 13 by a suitable lowering mechanism 42, shown only schematically, or even only the bending bolt 12 corresponding to the double arrow $P_{15}$. Bending bolt 12 can be lowered by a suitable lowering mechanism 43, shown only schematically. A resting plate 17''' which serves for supporting stirrups with long limb lengths and can be constructed in a stationary manner and for both frames 2, 2' jointly or in two parts connected to the frames. It is illustrated only diagrammatically.

The drive and operating elements necessary for the movement of the individual devices are constructed in a known manner and have been omitted in FIGS. 1 and 2 for the sake of clarity shown only schematically.

In the embodiment illustrated in FIG. 2, the gripper jaws, instead of engaging in the receiving position between parallel conveyor elements of the bar feed device 18 could also be arranged before the run-off end or below the run-off end of the conveyor units or unit, if a single continuously circulating conveyor member is used.

Figure 3:
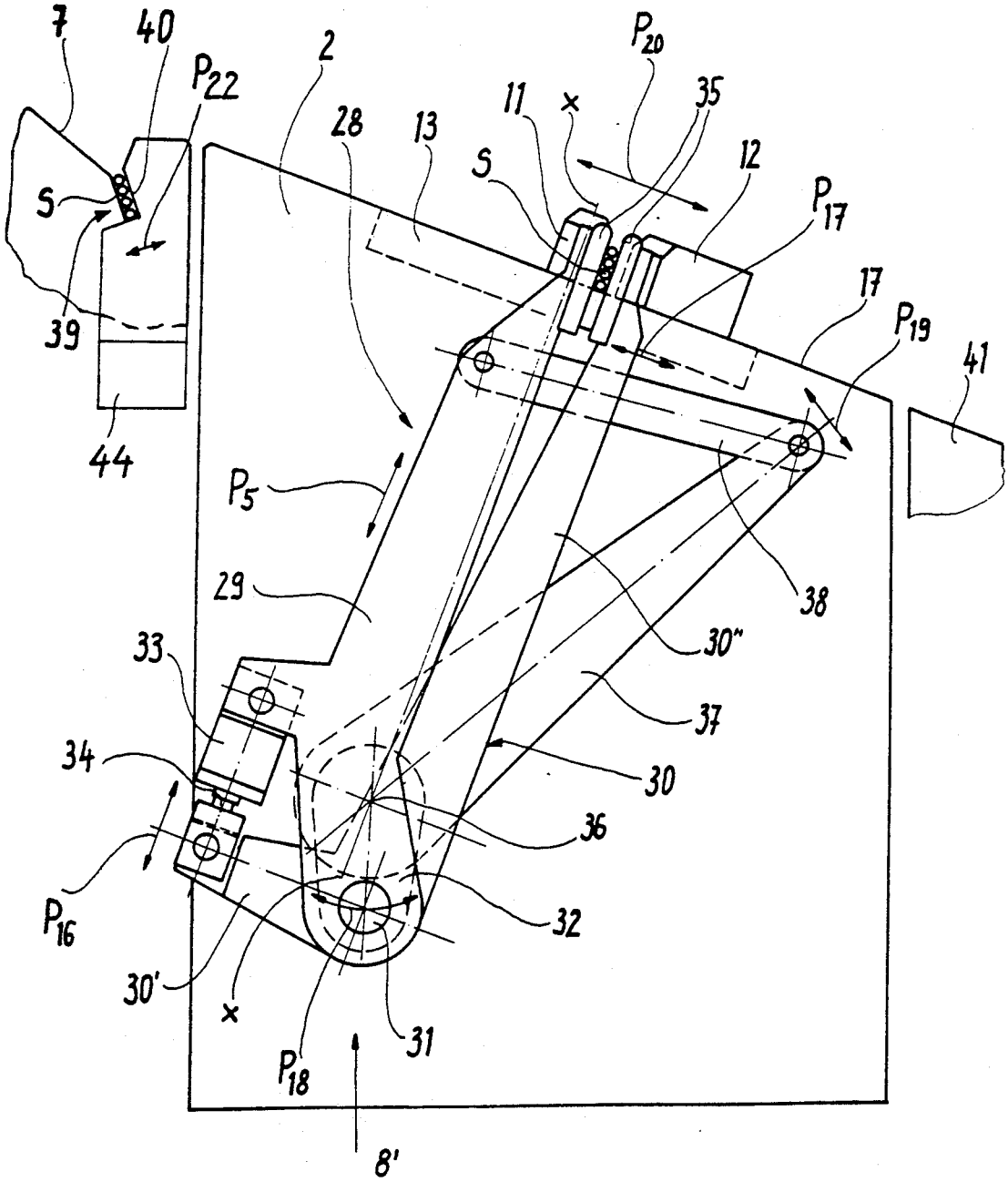

An alternative embodiment of the bar gripping and transfer device 8' (see FIG. 3) has two pairs of gripper tongs 28 which are each constructed as shown in FIG. 3, in which a view of the inside of the bending frame 2 is shown. The gripper tongs 28 have an angled clamping arm 29 and a likewise angled clamping lever 30 which is formed by a short lever arm 30' and a long lever arm 30''. The clamping arm 29 is mounted at one end on a pivot joint. The clamping lever 30 is pivotably mounted at its angled point on the joint. The joint is formed by an eccentrically arranged bearing pin 31 of an eccentric crank 32 indicated only by dashed lines. Mounted on the clamping arm 29 as drive device is a hydraulically operable operating piston-cylinder unit 33, the piston rod 34 of which is linked to the short lever arm 30' of the clamping lever 30.

By operation of the drive device 33, the piston rod 34 executes a linear movement corresponding to the double arrow $P_{16}$ so that the clamping lever 30 is swivelled relative to the clamping arm 29 corresponding to the double arrow $P_{17}$, so that the bars S are clamped between clamping jaws 35 at the free end of the clamping arm 29 and of the lever arm 30''.

The clamping jaws 35, which are parallel to each other in the closed position, consist of resilient material which is as resistant to wear as possible so that a plurality of bars S can be clamped securely even in the case of the position of the clamping jaws not being completely parallel and in the case of deviations in the diameter of the individual bars.

The eccentric crank 32 forming the swivel arm for the gripper tongs is mounted with its swivel axis 36, which lies on the axis X—X of the central bending mandrel 11, on the inside of the respective bending frame 2 or 2' and executes a swivel movement corresponding to the double arrow $P_{18}$ (FIG. 3) under the effect of a drive device (not illustrated). In addition, a swivel arm 37 is mounted concentrically to the swivel axis 36 of the eccentric crank 32 so as to be swivellable on the inside of the respective bending frame 2 or 2', which swivel arm executes a swivel movement corresponding to the double arrow $P_{19}$ under the effect of a further drive device (likewise not illustrated). In this case, the bearing of the swivel arm 37 can be formed, for example, by a hollow shaft (not illustrated), in which the eccentric crank 32, in turn, is mounted concentrically.

The free end of the swivel arm 37 is coupled to the clamping arm 29 via a connection strap 38, the attachment point being located as near as possible to the free end of the clamping arm 29. The connection strap 38 effects a forced coupling of the movements of the clamping arm 29 and of the clamping lever 30.

Operation, embodiment of FIG. 3: The bars S pass via a buffer and guide surface 7, constructed corresponding to the exemplary embodiment according to FIG. 1, into a collection device 39 which is indicated only diagrammatically and is arranged on a stationary component (not shown) of the apparatus. The collection device 39 preferably has U-shaped cross section and a depth such that all the bars to be bent simultaneously are arranged above one another in the correct position and can be picked up by the gripper tongs 28. For adapting the collection device 39 to different diameters of the bars to be bent, a side wall 40 of the collection device 39 can, if appropriate, be constructed so that it can be displaced in parallel relative to the opposite side wall, as illustrated by double arrow $P_{22}$, by a suitable mechanism, shown only schematically at 44.

For taking over the bars from the collection device 39, the gripper tongs 28 are swivelled into the receiving position defined by the collection device 39 by operating the eccentric crank 32 and the swivel arm 37 corresponding to the double arrow $P_{20}$. By operating the drive device 33, the clamping lever 30 swivels towards the clamping arm 29 corresponding to the double arrow $P_{17}$ so that all the bars are clamped securely between the clamping jaws 35. Before the bars are fastened in the gripper tongs 28, if appropriate, the bars are aligned at their ends by means of an alignment device described with reference to FIG. 1 (not illustrated in FIG. 3).

By further operation of the eccentric crank 32 and the swivel arm 37, the bars, now clamped between clamping arm 29 and clamping lever 30, pass into the bending position between the bending members 11, 12, arranged on the bending base 13.

During the adjustment of the bending frame or bending frames 2 or 2', the bars are held fast by means of the gripper tongs 28 of one of the bending frames, whereas the gripper tongs 28 of the other bending frame are opened slightly for guiding the bars lying above one another in order to allow the bars to glide between the clamping jaws 35 without changing the bar arrangement.

Alternatively it is also possible within the scope of the invention to open the gripper tongs 28 of the other bending frame mentioned above completely and to guide the bars only through the bending members 11, 12 which form a suitably narrow guide gap.

In order to be able to carry out a reversal of the bending direction in the exemplary embodiment of an apparatus according to the invention described with reference to FIG. 3, the eccentric crank 32 is operated and the swivel arm 37 is swivelled in such a way that the clamping arm is jointly lifted corresponding to the double arrow $P_5$. The bars 29, held by the closed gripper tongs 28, and the clamping lever 30 are thus lifted out of the bending position, and are subsequently transferred by joint swivelling of the clamping arm 29 and the clamping lever 30 corresponding to the double arrow $P_{20}$ from one side of the central bending mandrel 11 to the other side of the latter and finally, after the change in position of the bending bolt 12 has been completed, are lowered into the new bending position by joint lowering of the clamping arm 29 and the clamping lever 30 corresponding to the double arrow $P_5$. The eccentric crank 32 and the swivel arm 37 are matched to each other in their sequences of movement in such a way that, during the transfer movements, the bars lying above one another remain aligned, and always parallel to the central bending mandrel 11.

After completion of all the bending operations, the eccentric crank 32 and the swivel arm 37 are again operated so that the bars are lifted out of the bending position with the gripper tongs 28 closed by joint lifting of the clamping arm 29 and the clamping lever 30 corresponding to the double arrow $P_5$. Subsequently, the bars are swivelled out of the region of the resting surface 17 of the bending frame 2 by joint swivelling of the clamping arm 29 and the clamping lever 30 corresponding to the double arrow $P_{20}$ and are finally placed with the aid of the clamping drive device 33 on a preferably inclined run-off plate 41 by joint lowering of the clamping arm 29 and the clamping lever 30 and after the gripper tongs 28 have been opened.

The bar gripping and transfer device 8' in accordance with FIG. 3 and the collection device described can also be used in the embodiment illustrated in FIG. 2.

In order to be able to carry out a reversal of the bending direction in the apparatus according to FIGS. 1 and 2, as in the exemplary embodiment according to FIG. 3, the swivel arms 9 and the gripper tongs 10 are actuated for transferring the bars from one side of the central bending mandrel 11 to the other side of the latter. Furthermore, these swivel arms and gripper tongs are actuated for lifting out and discharging the bars after completion of all the bending operations.

A control device (not illustrated) is provided for controlling the actuable, movable devices and for matching the movements of these devices to one another and for controlling and monitoring the bar transport from the feed devices into the bending device, in particular for individual controlling of the swivel arms and the gripper tongs and for carrying out the required bending processes on the bars, by means of which control device the drive and operating elements are controlled.

It is understood that the invention is not restricted to the exemplary embodiments illustrated; on the contrary, these can be modified in various ways within the framework of the general concept of the invention. In particular, in the exemplary embodiment shown, more than two swivel arms with gripper tongs could be provided which operate alternately in order to allow a continuous operation.

The bar feed device 3, 4 of FIG. 1 as well as the bar feed device 18 of FIG. 2 are preferably both installed to permit selective use and, in case of a feeding difficulty in one of them, to provide for an alternate feed of bars to the apparatus.

We claim:

1. Apparatus for bending a plurality of steel bars to form concrete reinforcement elements or stirrups, said apparatus defining a longitudinal direction parallel to a longitudinal direction of the bars, said apparatus having a bar feed device;

two bending frame means (2, 2'), each bending frame means including bending members (11, 12) spaced from each other and defining a bar gap;

means for adjustably mounting said bending frame means for adjustment relative to each other in a longitudinal direction of the apparatus, and comprising a bar gripping and transfer device (8, 8') coupled to each of the bending frame means (2, 2'), the bar gripping and transfer devices each having gripper tongs (10, 28) and conjointly movable gripping jaws (14', 14''), said gripper tongs being movable between a receiving position for receiving and clamping a plurality of bars between the gripping jaws (14', 14''), and a discharge position for placing said plurality of bars clamped in the gripping jaws in the bar gap of the bending members (11, 12);

a buffer and guide surface (7) positioned transversely with respect to the longitudinal direction of the apparatus and located in the vicinity of the receiving position of the gripper tongs (10, 28), said buffer and guide surface (7) receiving the bars from the bar feed device (3, 4; 28); and a common bar alignment device (15) operatively associated with the buffer and guide surface (7) for aligning at least one of the ends of the bars with respect to a reference so that said bars can be placed within the gripper jaws (14', 14") at the receiving position when in alignment.

2. The apparatus of claim 1, wherein said movable gripper tongs (10, 28) include an adjustable swivel arm for pivotably mounting the respective gripping tongs (10, 28) on the associated bending frame means (2, 2').

3. The apparatus of claim 2, wherein said gripping jaws (14', 14") of said gripper tongs define a gripping head (10), said gripping head being pivotably mounted on said swivel arm (9) for joint movement of the gripping jaws (14', 14").

4. The apparatus of claim 1, wherein said common buffer and guide surface (7) is positioned adjacent said bar feed device (3) to receive the plurality of feed bars adjacent each other.

5. The apparatus of claim 1, wherein said bar feed device (18) includes at least two parallel continuously circulating conveyor elements (19); and wherein the gripper tongs (10), when in the receiving position, engage between two of said parallel continuously circulating conveyor elements.

6. The apparatus of claim 5, wherein the bar feed device (18) further includes a dropping and distributor device (22) having an exit channel (24);

swivel means (5', 6') positioned to receive said bars from the bar feeding device, and individually feeding said bars to said exit channel (24); and a distributor flap (25) located beneath the exit channel and directing a bar (S), respectively, to said conveyor elements (19) or to a discharge chute (27) away from the bending frames (2, 2').

7. The apparatus of claim 1, including control means (30', 31, 32, 33, 34, 37, 38; $P_6$, $P_7$) coupled to the gripper jaws (14', 14"; 35) for clamping the bars (S) and controlling said clamping during at least one of:

bending operation of said bending members of the bending frame means;

adjustment of said bending frame mans (2, 2') relative to each other in the longitudinal direction of the apparatus (1).

8. The apparatus of claim 1, wherein said bending members (11, 12) are coupled to form a bending head (13, 13'); and wherein said bending head (13, 13') is movable in the respective bending frame means (2, 2') from the receiving position to the discharge position of the bending head to permit insertion of said rods (S) between the bending members (11, 12) of the respective head (13, 13'), when the gripper tongs are moved into the discharge position, and simultaneous bending of a plurality of bars.

9. The apparatus of claim 1, wherein the bending members (11, 12) of each bending frame means (2, 2') are located on a respective bending head (13, 13');

and wherein the bending head is slidable in the respective bending frame means in the longitudinal direction.

10. The apparatus of claim 1, further including an engagement or resting surface (17) operatively associated with each bending frame means (2, 2'), said rest surface having at least a portion (17", 17"') located above the moving range of said gripper tongs when the gripper tongs are in an extreme position, said rest surface supporting bent limbs of the bars after the bending members have bent the bars.

11. The apparatus of claim 1, wherein each one of the gripper tongs (28) includes a clamping arm (29) and a clamping lever (30), said clamping lever being pivotable towards and away from said clamping arm;

a bearing pin (31) pivotably coupling said clamping arm (29) and said clamping lever (30) together;

drive means (33, 34) engageable with both said clamping arm (29) and said clamping lever (30) for relative pivoting movement of said clamping arm and clamping lever towards and away from each other;

and means for controlling the movement of said clamping arm (29) and clamping lever (30) forming said tongs comprising an eccentric crank (32) secured in the respective bending frame means (2, 2') and operable for moving the respective tongs between the receiving position and the insertion position, said eccentric crank retaining the bearing pin;

a separately drivable swivel arm (37) mounted concentrically to said eccentric crank on the respective bending frame means; and coupling strap means (38) connecting the swivel arm (37) to the clamping arm (29).

12. The apparatus of claim 1, wherein said bending members (11, 12) define a central bending mandrel (11) and a bending bolt (12) spaced from said bending mandrel;

and wherein said gripper tongs (10, 28) are movable to a discharge position on either side of said mandrel (11), with respect to movement of the respective gripper tongs between said receiving and discharge position.

13. The apparatus of claim 1, wherein the gripper jaws (14', 14"; 35) of one of said gripper tongs are controllable for slight release of gripping pressure to permit guiding of a plurality of bars (S) in the jaws upon adjustment of position of one of the bending frame means (2, 2').

14. The apparatus of claim 1, wherein said gripper tongs (10, 28) are additionally movable to an ejection position, said tongs gripping the bars, after completion of a bending operation, in the discharge position, and moving said then bent bars into the ejection position;

and ejection guide mean (41) are provided for receiving the bent bars from the ejection position, said tongs opening the gripper jaws when in the ejection position to permit release of the bent bars.

15. The apparatus of claim 1, further including a bar collection device (39) for receiving a plurality of bars from said buffer and guide surface (7);

and wherein the gripping jaws (14, 14'; 35) receive the bars from said collection device when in the receiving position.

16. The apparatus of claim 15, wherein the collection device, in cross section, defines an essentially U-shaped channel having a pair of opposed side walls;

and wherein at least one of said side walls (40) is movable towards and away from the other to provide for adjustment in accordance with the thickness of the bars (S) collected in said collection device.

17. The apparatus of claim 1, wherein said common bar alignment device (15) comprises a stationary stop (15") and a displaceable stop (15').

* * * * *